US005615503A

United States Patent [19]

Current

[11] Patent Number: 5,615,503

[45] Date of Patent: Apr. 1, 1997

[54] HEIGHT ADJUSTABLE SIGN HOLDER

[75] Inventor: Wayne A. Current, Homdel, N.J.

[73] Assignee: International Visual Corp., Port Washington, N.Y.

[21] Appl. No.: 483,725

[22] Filed: Jun. 7, 1995

[51] Int. Cl.[6] ..... G09F 15/00

[52] U.S. Cl. ..... 40/601; 40/606

[58] Field of Search ..... 40/606, 601, 605, 40/611, 642, 649, 661

[56] References Cited

U.S. PATENT DOCUMENTS 2,559,106 7/1951 Bishop et al. ..... 40/606

4,144,664 3/1979 DeKorte ..... 40/611 X 4,329,800 5/1982 Shuman ..... 40/606

4,368,586 1/1983 Forzelias ..... 40/606 X

*Primary Examiner*—Brian K. Green

*Assistant Examiner*—Cassandra Davis

*Attorney, Agent, or Firm*—Collard & Roe

[57] ABSTRACT

A device for displaying a sign at various heights, including a base and a pair of spaced, parallel uprights extending upwardly from the base. A cardholder is slidably positioned between the uprights with the sign being removably mounted to the cardholder. A frictional retaining force exerted between the uprights and the cardholder maintains the cardholder and the sign at various heights.

9 Claims, 2 Drawing Sheets

HEIGHT ADJUSTABLE SIGN HOLDER

BACKGROUND OF THE INVENTION

1. Field of the Invention

The present invention relates to a height adjustable sign holder. More particularly, it relates to a translucent panel assembly on which the sign is mounted and which is height adjustable with respect to a base.

2. The Prior Art

Cardholders are known for displaying a sign which is removably mounted to the cardholder. One of the more prevalent types of prior art cardholders is the fixed-height, metal-based cardholder. These metal cardholders have numerous drawbacks including their weight, cost, and lack of flexibility in setting the height of the displayed sign.

Certain attempts to provide adjustable display devices are disclosed in U.S. Pat. No. 4,329,800 and U.S. Pat. No. 4,368,586. However, these patents require that the frame surrounding the cardholder be moved along with the sign. Therefore, it would be desirable to provide a height adjustable sign holder in which the cardholder panels alone can be selectively raised and lowered.

SUMMARY OF THE INVENTION

It is therefore an object of the present invention to overcome the drawbacks of the prior art and to provide a sign holder which displays a sign at various heights.

It is a further object of the present invention to provide a sign holder where the frame is stationary and only the cardholder panels are moved.

These and other related objects are achieved according to the invention by a device for displaying a sign at various heights. The device includes a base and a pair of parallel, spaced-apart uprights extending upwardly from the base. The device also includes a cardholder which is slidably disposed between said uprights with the sign being removably mounted to said cardholder. The cardholder exerts a frictional retaining force against the uprights, so that the cardholder and the sign are selectively maintained at various heights with respect to the base.

The device has a translucent front panel and a rear panel, and the sign is sandwiched between said panels so that it remains flat and visible through the translucent front panel. The cardholder is comprised of two identical translucent panels, each including key means and slot means for matingly engaging with each other.

The device includes two spaced lateral sides and a contoured rail along each lateral side which engages the uprights. The uprights include correspondingly contoured channels shaped and configured for receiving said contoured rails. The contoured rails each have T-shaped cross-section with each of the two panels extending to said two lateral sides to form part of said rail. Each rail comprises a portion of a front panel having an L-shaped cross-section and a portion of a rear panel having a mirror-image L-shaped cross-section, wherein the L-shaped cross-section and the mirror-image L-shaped cross-section are placed back-to-back to form said contoured rail with a T-shaped cross-section.

The uprights and the cardholder are disposed in a common vertically-extending plane. The base is polygonal with two opposed sides which are parallel to each other and parallel to the vertically-extending plane. The base includes two stepped connection members and each of the uprights includes a lower end and an inversely stepped connection member at the lower end for plugging the upright into the stepped connection member of said base. The uprights are permanently affixed to said base.

The contoured channels have a T-shaped upper portion and a U-shaped lower portion. The contoured rail has a bottom end and a projection extending outwardly from the bottom end. The U-shaped channel contains a plurality of recesses formed therein, each one selectively accommodating said projection for releasably retaining the cardholder in various positions.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
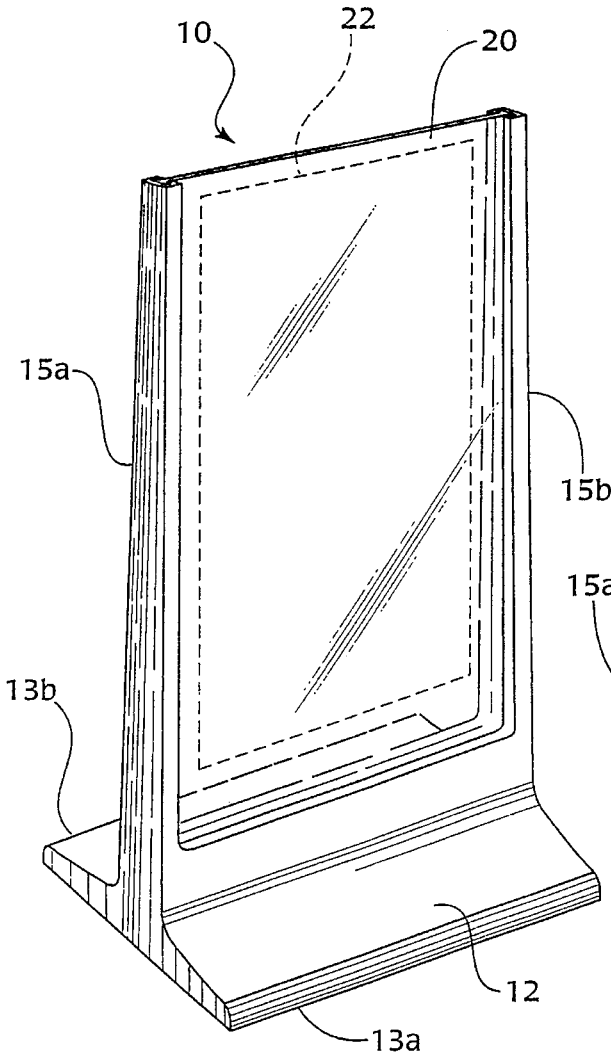
FIG. 1 is a perspective view of a height adjustable sign holder according to the invention, with the cardholder in the lowered position.
Figure 2:
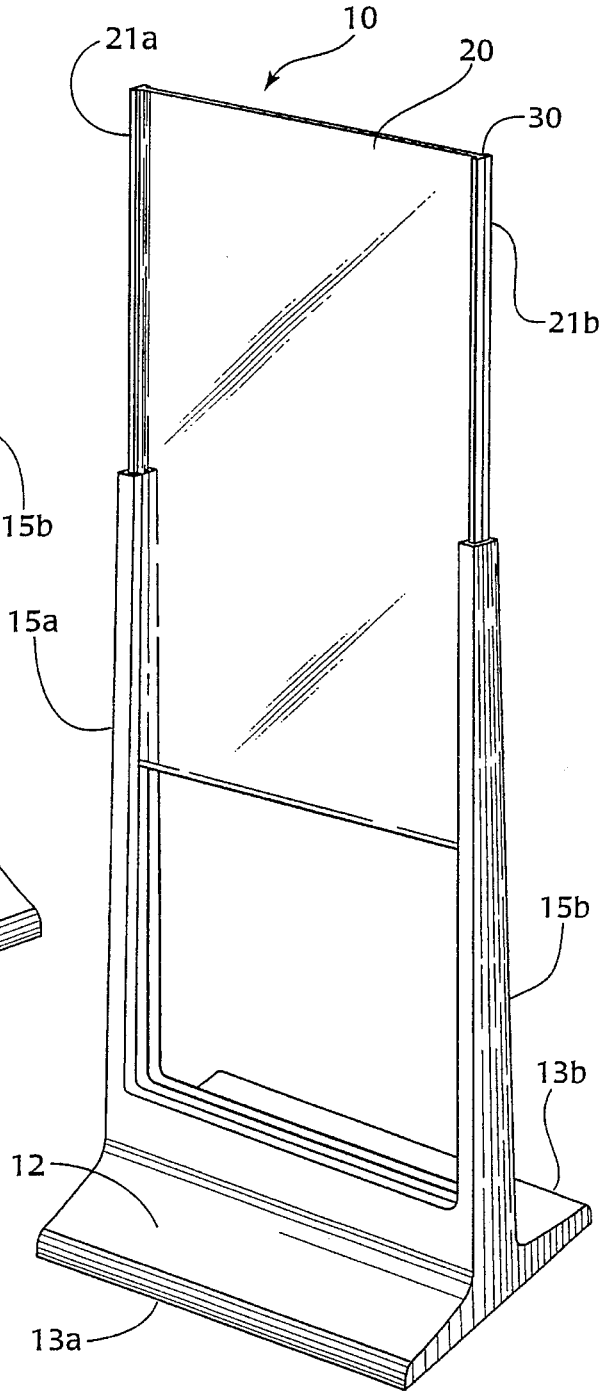
FIG. 2 is a perspective view of the height adjustable sign holder with the cardholder in the raised position.

Turning now in detail to the drawings and, in particular FIGS. 1 and 2, there is shown a height-adjustable sign holder 10 having a base 12 with a pair of spaced parallel uprights 15*a* and 15*b* extending upwardly therefrom. A cardholder 20 is slidably positioned between uprights 15*a* and 15*b* to display a sign 22 which is removably mounted within cardholder 20. Cardholder 20 has lateral sides 21*a* and 21*b* which slide within uprights 15*a* and 15*b*, respectively. Each lateral side 21*a* and 21*b* of cardholder 20 is designed as a contoured, T-shape rail 30 which fits within a correspondingly-shaped channel 16 within uprights 15*a* and 15*b*.

Figure 3A:
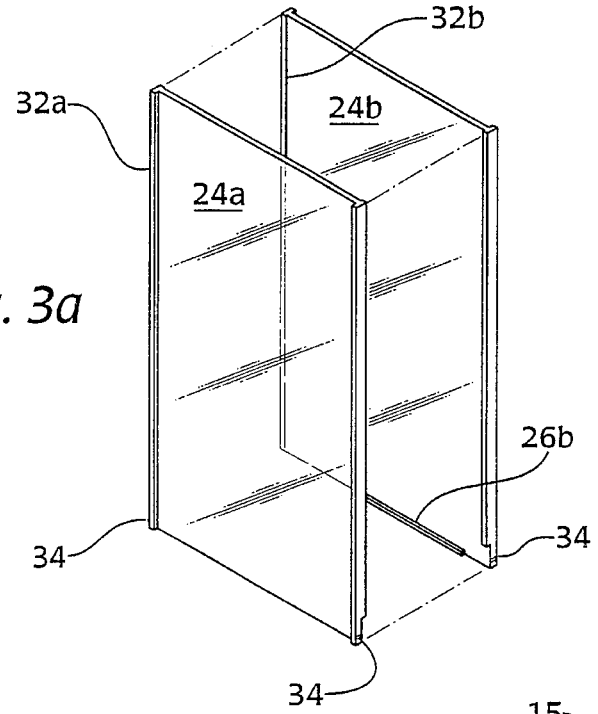
FIG. 3*a* is an isometric view of the cardholder components, just prior to assembly.
Figure 3B:
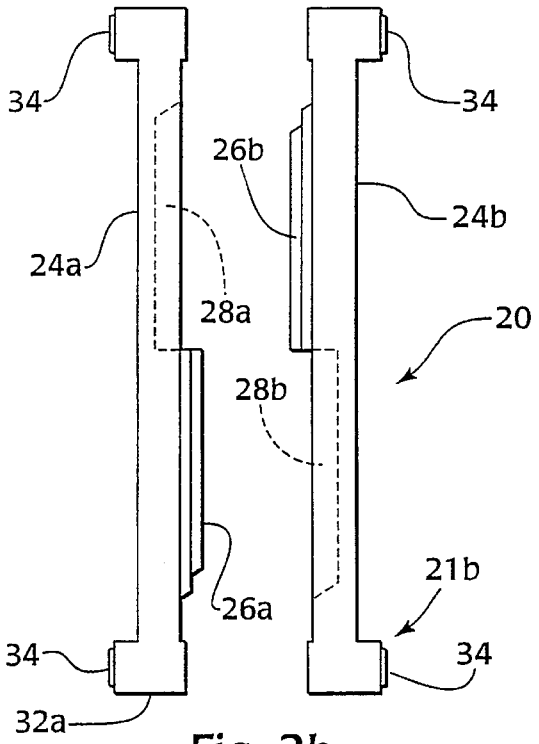
FIG. 3*b* is a bottom plan view of the cardholder components.

As can be seen in FIGS. 3*a* and 3*b*, cardholder 20 consists of a first panel 24*a* and a second panel 24*b*. At least one of the panels 24*a* and 24*b* is translucent so that the sign, which is sandwiched between panels 24*a* and 24*b* is visible through the translucent panel. Panels 24*a* and 24*b* may consist of two identical translucent panels including a key 26*a* and 26*b* and a slot 28*a* and 28*b*, respectively. The keys and slots are positioned along a periphery so that upon inverting one of the panels, panels 24 and 24*b* may be fitted together with the keys matingly engaging the slots on the other panel. The panels are then ultrasonically welded together at the keys and slots. Sign 22 is sandwiched between the panels, above the keys and slots. In the completely raised position, the panels may be sprung open to replace the sign. The lateral side 21*b* consists of an L-shaped cross-section 32*b* and a mirror image L-shaped cross-section 32*a* which together form the T-shaped, contoured rail 30 at each lateral side of the cardholder 20.

Figure 4:
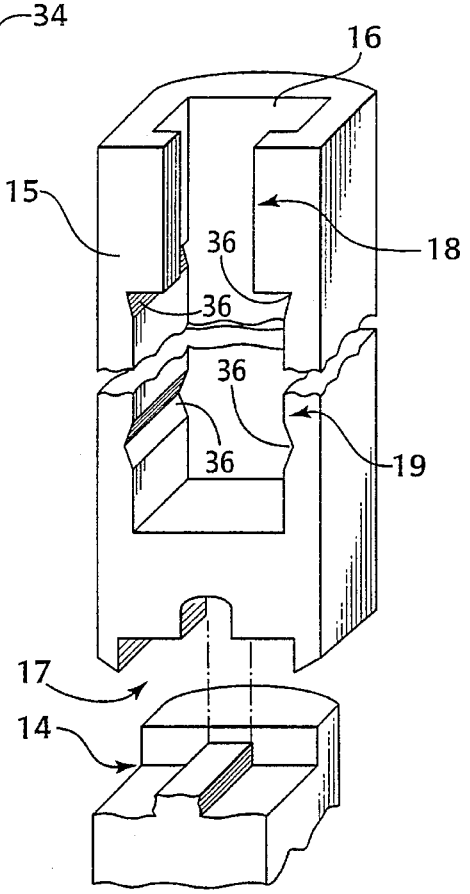
FIG. 4 is a perspective view of an upright positioned above the base.

Referring now to FIGS. 1, 2, and 4, uprights 15*a* and 15*b* are attached to base 12 and permanently affixed thereto. The uprights and base may also be integrally molded. The uprights and cardholder 20 are disposed within a vertically-extending plane. Base 12 includes two opposed parallel sides 13*a* and 13*b* which are also parallel to the vertically-extending plane. Base 12 includes two-stepped connection members 14. At the lower end of each upright 15*a* and 15*b*, an inversely-stepped connection member 17 is provided for plugging the upright into the corresponding stepped connection member 14. The channel 16 within each upright consists of an upper T-shaped portion 18 and a lower U-shaped portion 19. The uprights and channels constitute two external adjustment tracks for vertically guiding the cardholder through a continuous series of positions.

As can be seen in FIGS. 3*a*, 3*b* and 4, the bottom end of each contoured rail 30 includes projections 34. The U-shaped channel portion 19 includes a plurality of recesses 36 formed along its height. The plurality of recesses 36 accommodates projections 34 for releasably retaining cardholder 20 at various heights. Cardholder 20 is movable from its lowest position, shown in FIG. 1 through various positions to an upper position, shown in FIG. 2. Although the top of cardholder 20 may be extended substantially beyond uprights 15, the T-shaped portion 18, at the upper end of uprights 15, maintains panels 24*a* and 24*b* in substantially face-to-face relationship with sign 22 sandwiched therebetween. Alternatively, channel portion 19 has smooth surfaces devoid of any recesses. This allows cardholder 20 to be continuously adjustable along the height of the uprights.

While only a single embodiment of the present invention has been shown and described, it is to be understood that many changes and modifications may be made thereunto without departing from the spirit and scope of the invention as defined in the appended claims.

What is claimed is:

1. A device for displaying a sign at various heights comprising:

a base having a pair of parallel, spaced-apart uprights extending upwardly from said base; and a cardholder slidably disposed between said uprights and comprising two panels adapted to removably sandwich the sign therebetween, said cardholder including two spaced-apart lateral sides, each side including a rail with a T-shaped cross section, each of said two panels extending to said two lateral sides to form part of each of said T-shaped rails having a means for exerting a frictional retaining force against said uprights so that said cardholder and the sign are selectively maintained at various heights with respect to the base.

2. The device according to claim 1, wherein said two panels comprise two substantially identical translucent panels, each including key means and slot means for mating said two panels together.

3. The device according to claim 1, wherein each of said uprights includes a correspondingly contoured channel shaped and configured to receive said rails.

4. The device according to claim 3, wherein each rail comprises a portion of said front panel having an L-shaped cross-section and a portion of said rear panel having a mirror-image L-shaped cross-section, wherein the L-shaped cross-section and the mirror-image L-shaped cross-section are placed back-to-back to form said rail with a T-shaped cross-section.

5. The device according to claim 3, wherein said uprights and said cardholder are disposed within a vertically-extending plane.

6. The device according to claim 5, wherein said base is polygonal with two opposed sides which are parallel to each other and parallel to said vertically-extending plane.

7. The device according to claim 5, wherein said base includes two stepped connection members and each of said uprights includes a lower end and an inversely stepped connection member at said lower end for plugging said upright into said stepped connection member of said base, wherein said uprights are permanently affixed to said base.

8. The device according to claim 5, wherein said contoured channels have an upper portion comprising a T-shaped channel and a lower portion comprising a U-shaped channel.

9. A device for displaying a sign at various heights comprising:

a base having a pair of parallel, spaced-apart uprights extending upwardly from said base; and a cardholder comprising two substantially identical translucent panels adapted to demountably receive the sign therebetween, each of said two panels including key means and slot means for mating said two panels together, said cardholder being slidably disposed between said uprights and having a means for exerting a frictional retaining force against said uprights so that said cardholder is selectively maintained at various heights with respect to the base.

* * * * *